United States Patent [19]

Winslow et al.

[11] 4,428,271

[45] Jan. 31, 1984

[54] METHOD AND MEANS FOR ATTACHING REED TO WIND INSTRUMENTS

[76] Inventors: Thomas W. Winslow; John G. Winslow, III, both of 1106 Shasta Dr., Madison, Wis. 53704

[21] Appl. No.: 287,231

[22] Filed: Jul. 27, 1981

Related U.S. Application Data

[63] Continuation-in-part of Ser. No. 212,073, Dec. 1, 1980, abandoned.

[51] Int. Cl.[3] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,016,055 | 1/1912 | Winquist | 84/383 R |
| 1,446,623 | 3/1922 | Humes . | |
| 1,449,868 | 3/1923 | Miller | 84/383 R |
| 1,575,621 | 3/1926 | Chiron et al. | 84/383 R |
| 1,789,639 | 2/1929 | Selmer . | |
| 1,801,421 | 5/1929 | Gemeinhardt . | |
| 2,648,246 | 4/1949 | Mueller . | |
| 2,791,929 | 4/1955 | Bonade . | |
| 2,811,888 | 12/1956 | Stone . | |
| 3,150,554 | 9/1963 | Leloup . | |
| 3,205,753 | 9/1964 | Luyben . | |
| 3,410,170 | 10/1967 | Gigliotti . | |
| 3,413,884 | 5/1968 | Sciacca . | |
| 3,433,113 | 3/1969 | Portnoy . | |
| 3,890,873 | 6/1975 | Harrison . | |
| 4,056,997 | 11/1977 | Rovner . | |
| 4,210,055 | 7/1980 | Platamone . | |

FOREIGN PATENT DOCUMENTS

| | | | |
|---|---|---|---|
| 89067 | 11/1896 | Fed. Rep. of Germany | 84/383 R |

*Primary Examiner*—Lawrence R. Franklin

*Attorney, Agent, or Firm*—Keith Schoff

[57] ABSTRACT

A ligature for single reed wind instruments is configured with independently and adjustably loaded, resiliently urged posts for contacting and retaining the reed against the instrument mouthpiece, thereby providing enhanced vibrational and response characteristics to the mouthpiece assembly.

11 Claims, 29 Drawing Figures

FIG. 22
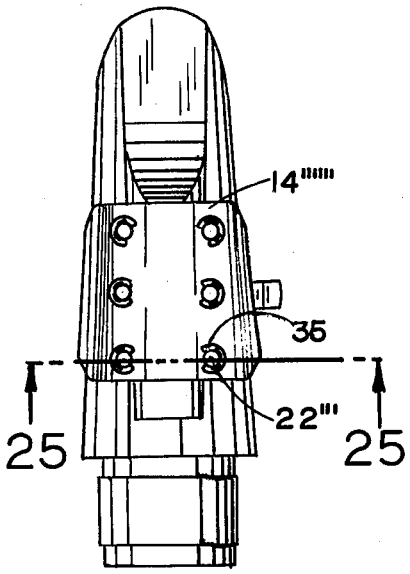
FIG. 24
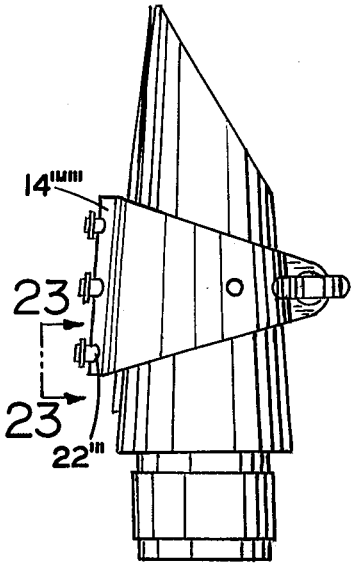
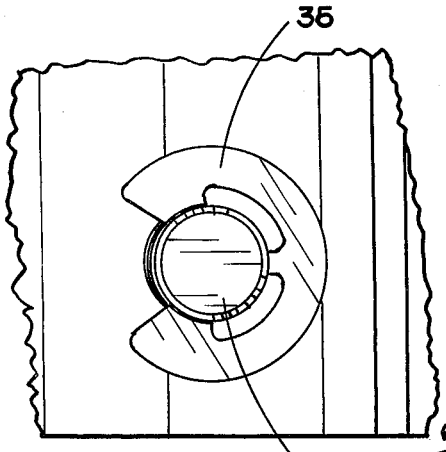
FIG. 23
FIG. 25
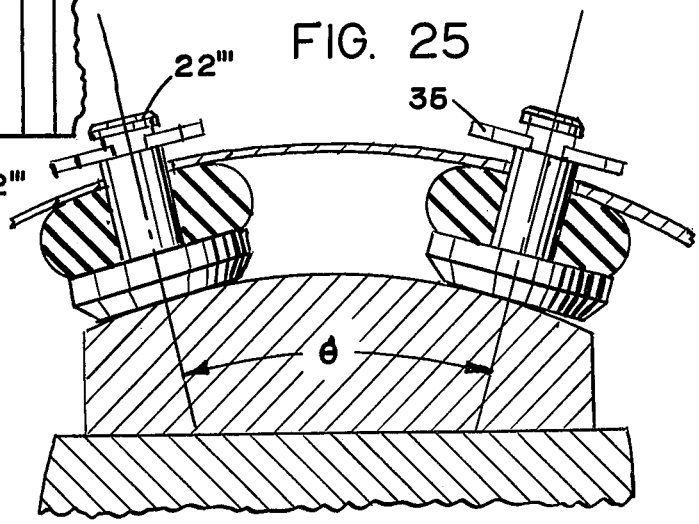

FIG. 26
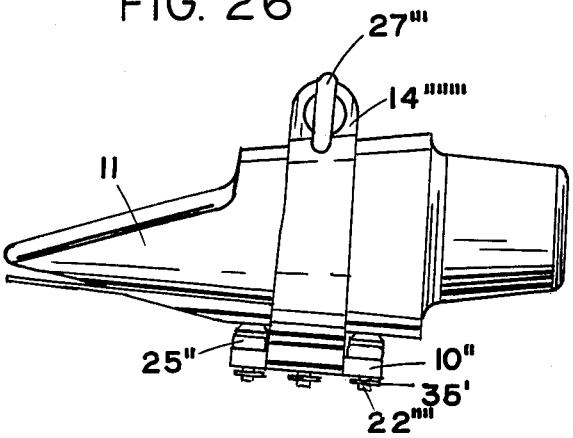
FIG. 28
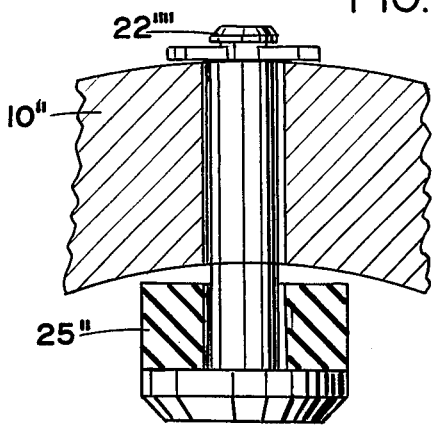
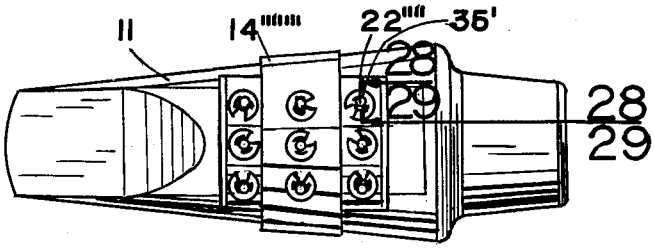
FIG. 27
FIG. 29
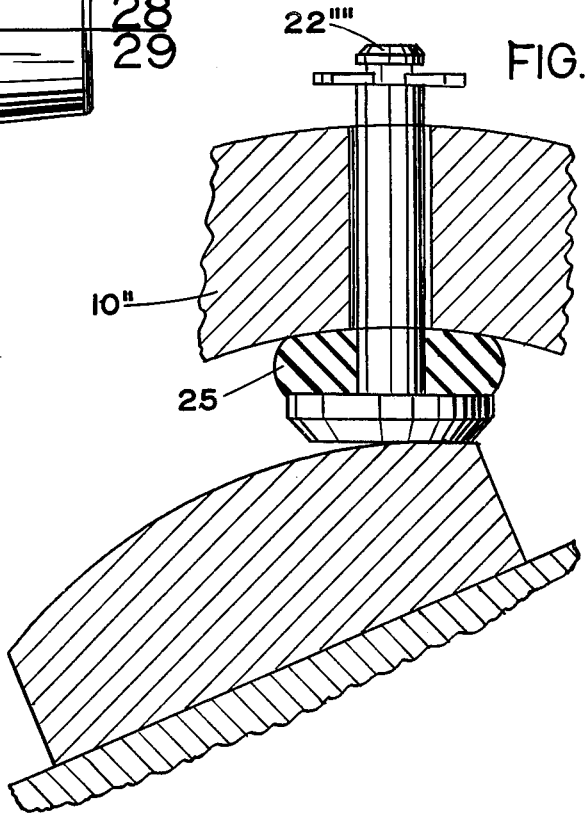

METHOD AND MEANS FOR ATTACHING REED TO WIND INSTRUMENTS

This is a continuation-in-part application of Ser. No. 06/212,073 filed Dec. 1, 1980, now abandoned.

BACKGROUND OF THE INVENTION

1. Field of Invention

The mouthpiece assembly of single reed wind instruments such as clarinets and saxophones embodies a mouthpiece body configured tubularly cylindrical at one end for being received and fastened on the body of the instrument and tapered toward the other end into a bill-like configuration with the wind passage aperture lying in a plane inclined to the axis of the mouthpiece, a striking reed disposed in contact with a flatted surface of the mouthpiece body and extending over the wind passage aperture for being caused to vibrate under wind pressure to variably constrict the air flow path to the aperture, and a banding device known as a ligature for clamping the reed on the mouthpiece body.

2. Description of the Prior Art

A ligature conventionally has one or two thumb screws for tightening the clamp about the mouthpiece body to forcibly press the reed into contact with the flatted surface of the mouthpiece body. A variety of presser feet designs have been provided on ligatures for contacting a reed including projecting lands which bear against the side extremities of the face of the reed to enable the center portion of the reed to vibrate; such lands have been provided with two contact posts each which may or may not be screw threaded to adjust seating pressure. A universally adjustable pivot mounting has also been provided on a ligature for contacting a reed to insure proper alignment of the seating plane of the reed with the flat on the mouthpiece body. Other presser feet have been provided to be adjustably movable on the ligature to accomodate reeds of various configurations. In all prior art devices, reeds have been retained by unyielding, non-resilient clamping either of a soft interfacing pad or of rigid presser feet with adjustment limited to that required to position the reed on the mouthpiece body without, however, providing independently, adjustably loaded, resilient cushioning of the force exerted by the clamp on each presser foot contacting the reed.

SUMMARY OF THE INVENTION

An improved ligature for all single reed, musical wind instruments, including all saxophones and clarinets, is provided which holds the reed securely while enabling it to vibrate fully for improved tonal quality, ease of blowing, and instrument response. This result is obtained by providing resilient cushioning means against which the reed is free to vibrate with an amplitude greater than when rigidly secured, coupled with independently adjustable multi-point seating of the reed on the mouthpiece body to insure proper conformance of faying surfaces even if the stock area of the reed surface is uneven.

Cushioning means for retaining the reed may be provided by any type of mechanical spring, or by any suitable elastomeric or plastomeric material. Spring means may be of compression, extension, bellville, cantilever, or bridge type, or other suitable type, and the spring constant of such means may be varied to suit an individual player's needs. If rubber-like elastomeric or plastomeric material is used, the durometer reading and physical characteristics of the material may be selected as desired.

In a preferred embodiment of the invention, single or multiple stem assemblies are free to independently float through holes in the ligature band. Any single stem assembly consists of a reed contact, whether a headed stem or nut, a spring or annular washer of resilient material, and a retainer nut or flange outside the band. Because the stem assemblies are independently biasable, individually adjustable, free floating, and comprised of resilient material, the reed is properly seated on the mouthpiece even if the reed stock surface is uneven. The resilient cushioning material may be helically or annularly configured or of other suitable configuration and is disposed against the inner facing surface of the ligature band for being resiliently biased as the ligature band is tightened around the mouthpiece and provides a cushion of variable compressive force for exerting pressure against the reed at each contact point. The phrase "contact point" as used herein refers to the centroid of the area of each post assembly component contacting the reed or mouthpiece. It is not a sharp point, but may be of varying area and may be of various geometries such as round, flat, rectangular, linear, convex, concave, plain or grated. The relative compression of each of the bolts, which serve as holding posts, can be equalized by individual adjustment tailored to suit a particular player's needs. However, a shoulder bolt is preferred. This is a stem with a flange instead of a retainer nut outside the band.

BRIEF DESCRIPTION OF THE DRAWINGS

FIG. 22 is a plan view of another embodiment of this invention showing a retainer ring snapped on a threaded stem assembly for retaining it in a ligature;

FIG. 23 is a top view showing in detail a portion of FIG. 22;

FIG. 24 is a side elevation of the embodiment of FIG. 22;

FIG. 25 is a cross sectional elevation of the embodiment of FIG. 22;

FIG. 26 is a side elevation of a mouthpiece assembly showing another embodiment of a ligature of this invention utilizing retainer rings for securing individual stem assemblies;

FIG. 27 is a plan view of the embodiment of FIG. 26 showing a maximum number of stem assemblies disposed in a ligature;

FIG. 28 is a cross-sectional elevation taken on cutting plane 28, 29—28, 29 of FIG. 27 showing a stem assembly in free floating position;

FIG. 29 is a cross-sectional elevation taken on cutting plane 28, 29—28, 29 of FIG. 27 showing a stem assembly in compressively biased position in contact with a reed.

DESCRIPTION OF THE INVENTION

Figure 1:
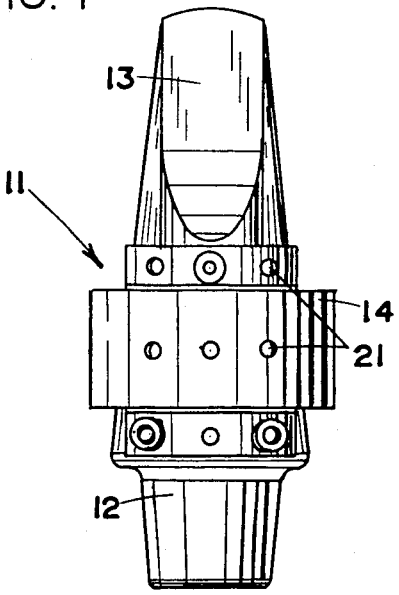
FIG. 1 is a plan view of a mouthpiece assembly of one embodiment of this invention.

Referring to the figures, in which like numerals designate like parts, mouthpiece assembly 11 for a single reed wind instrument such as a saxophone or a clarinet is shown in a variety of full or partial views as comprising mouthpiece body 12, reed 13, arcuate plate 10, and ligature band 14. As used herein "ligature" means the assembly of components including the ligature band which is tightened about the mouthpiece body of a wind instrument to secure the reed in place. In the embodiments of this invention, mouthpiece body 12 and reed 13 are conventional with the mouthpiece body being cylindrically tubular at one end, either as shown for being received on the tubular end of an instrument body in the manner of a saxophone or alternatively, for receiving therein the end portion of an instrument body in the manner customary for clarinet construction. Wind passage 15 extends longitudinally through mouthpiece body 12 to open through an aperture of approximately trapezoidal configuration which is disposed adjacent to reed 13 and located so as to be concealed from view in the figures. Flat 16 occupies a portion of the surface of mouthpiece body 12 against which a flat surface of reed 13 is disposed and retained in a manner which enables the reed, formed usually from a portion of cane stalk and tapered in thickness, to vibrate under the force of air blown into the instrument by a player, the reed being set to open and constrict the aperture to passage of air and to create a pulsating stream of air which contains the fundamental frequencies which the reed is capable of producing when subjected to vibration and which is emitted to a cylindrical air column formed in the musical instrument. Resiliency of reed 13 enables it to deflect vibratorily toward and away from the aperture responsively to differential of wind pressure exerted across its faces, exchanging the energy of momentum with that of the resisting force of mechanical bending through amplitude of movement determined by the resiliency of the material from which the reed is made, its geometry, and the firmness with which it is mounted.

In the embodiments of this invention cushioned mounting of the reed is provided as defined and exemplified by a ligature band being provided with an arrangement of apertures through which stem assemblies project in a desired array with each stem assembly providing independent cushioned retention of the reed, whether by mechanical spring or incorporation of elastomeric or plastomeric material individually in each stem assembly.

Figure 2:
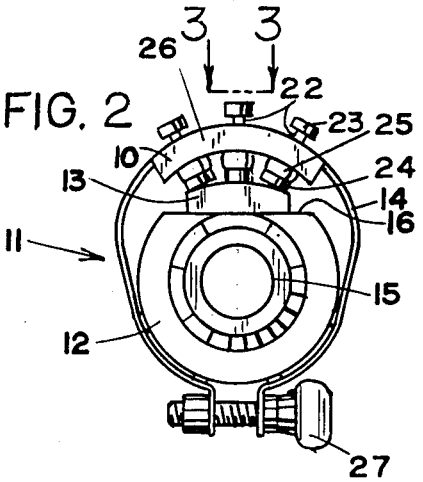
FIG. 2 is an end elevation of the embodiment of FIG. 1.
Figure 3:
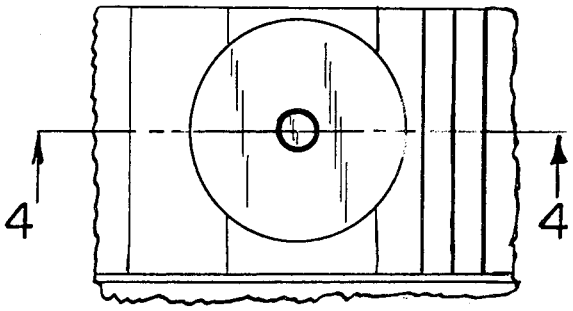
FIG. 3 is an enlarged detail view of a portion of FIG. 2 taken on line 3—3.
Figure 4:
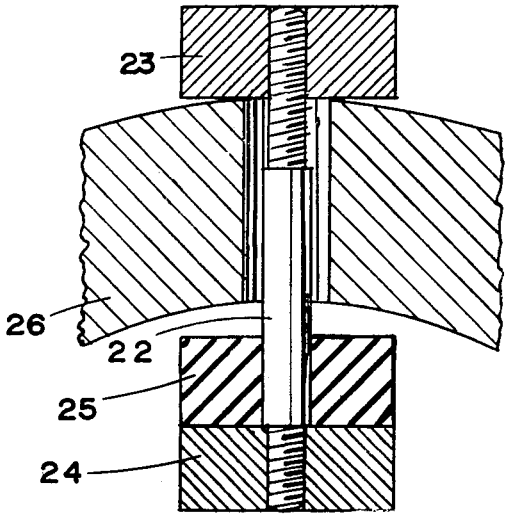
FIG. 4 is a cross-sectional elevation taken on cutting line 4—4 in FIG. 3 showing the stem assembly in free unclamped position.
Figure 5:
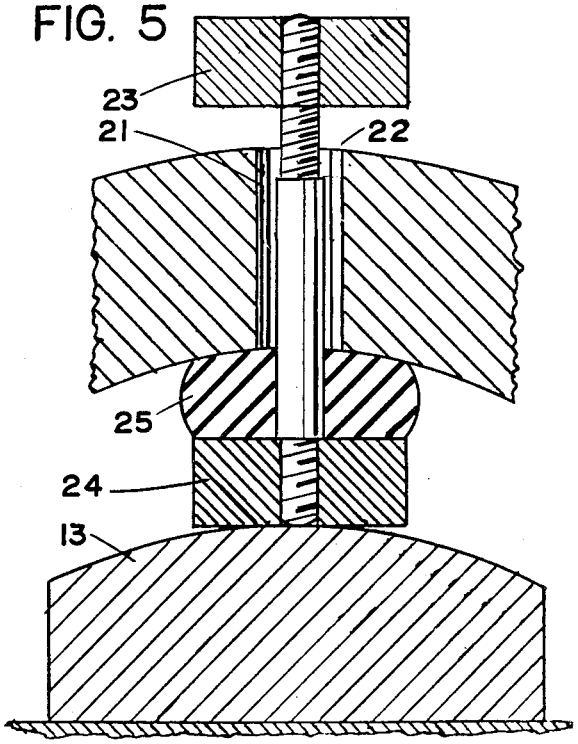
FIG. 5 is a cross-sectional elevation of the device of FIG. 4 showing the stem assembly in compressed position, exerting pressure against the reed.

In FIGS. 1 and 2, arcuate plate 10 is provided with nine apertures 21 is regular arrangement of three rows of three apertures each. The middle row of apertures is aligned in axial positions with similar apertures in ligature band 14. As shown, ligature band 14 is received in a recess in plate 10 with the upper surfaces of the two components being flush. Stem 22 projects through the apertures as shown in FIGS. 4 and 5 with the endmost portions of the stems threaded and fitted with reed-contacting head 24 and with retaining nut 23 at the upper end. Annularly configured, yielding, resilient member 25, shown to be elastomer or plastomer in FIGS. 4 and 5, is disposed between head 24 and cross-sectional portion 26 of plate 10 for being resiliently compressed as shown in FIG. 5 when ligature band 14 is tightened about mouthpiece body 12 by manipulation of thumbscrew 27. Member 25 can yieldingly absorb energy of vibration imparted by reed 13 in a manner which returns the energy to the reed enabling the reed to deflect more freely and with greater amplitude than would be possible with a more rigid mounting. Vibrational damping is minimized with assemblies utilizing members 25, whether such means comprise rubber-like cushion or mechanical spring, by energy storage and release being accomplished with little loss with the result that instrument response is enhanced in comparison to that provided by rigidly seated reeds.

Figure 6:
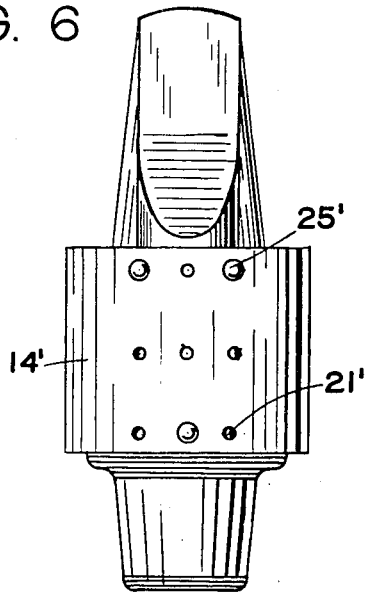
FIG. 6 is a plan view of another embodiment of a ligature of this invention shown in conjunction with a mouthpiece assembly.
Figure 7:
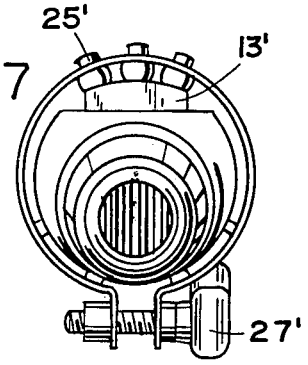
FIG. 7 is an end elevation of the mouthpiece assembly of FIG. 6.
Figure 8:
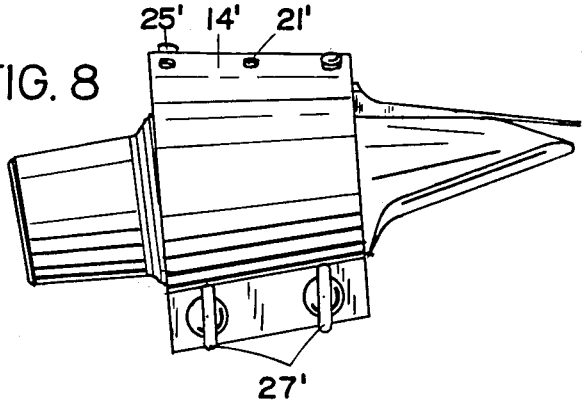
FIG. 8 is a side elevation of the device of FIG. 6.

In FIGS. 6, 7, and 8 a modified embodiment of the invention is shown wherein ligature 14′ is provided with resilient elastomeric member 25′ configured with stepped diameters, the smaller portion of which snugly fits in opening 21′ and is retained therein by friction fit, and the larger diameter portion of which is disposed between ligature 14′ and reed 13′ and is variably tightened against the reed by adjusting thumbscrew 27′ on ligature 14′. Members 25′ may readily be snapped out of a particular opening 21′ and repositioned in another to suit one's needs. If desired, elastomer and metal may be molded into a unitary member to provide metal contact points interfacing with the reed. It is also possible, but not preferred to provide resilient yieldable means interfacing the ligature and the mouthpiece body rather than between the ligature and the reed, the effect provided being the same as described hereinabove, but less pronounced in providing vibrational freedom to the reed.

Figure 10:
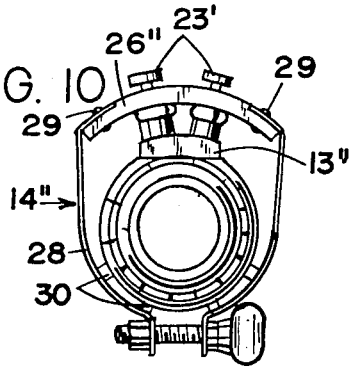
FIG. 10 is an elevation of another embodiment of a ligature showing riveted construction.

In FIG. 10, a further modification of an embodiment of the invention is shown wherein ligature band 14'' comprises relatively flexible band portion 28 attached by rivets or other comparable fastening means to relative rigid band portion 26''. Spacers 30 are provided configured as lands disposed between the ligature band and the mouthpiece body for minimizing vibrational damping by the ligature, and for providing full frequency and amplitude response by the cushioning system used. Herein, "cushioning system" means a ligature providing any type of spring, set of springs, spring system, or spring type, or any yieldable resilient material either compressed, extended, or deflected or expanded which acts as a cushion against which the reed can fully vibrate and yet be held securely in position on the instrument mouthpiece by a choice of contacts.

Figure 11:
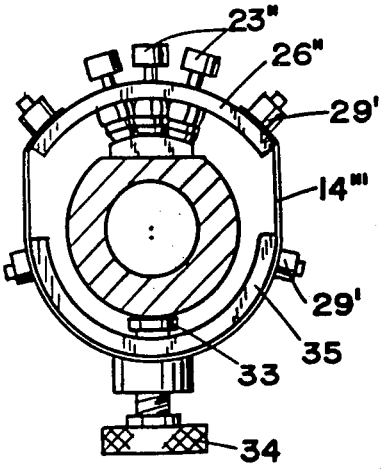
FIG. 11 is an elevation of another embodiment of a ligature of this invention.

In FIG. 11 another modified embodiment of a ligature is shown comprising two arcuate rigid portions 26'' and 35, the latter being banded by ligature band 14''' and fastened thereto, as is portion 26'', by fastening means 29'. Threaded thumbscrew 34 is used to tighten the ligature about an instrument mouthpiece by seating head portion 33 thereagainst. The design of FIG. 11 affords a great degree of vibrational freedom to a mouthpiece assembly.

Figure 12:
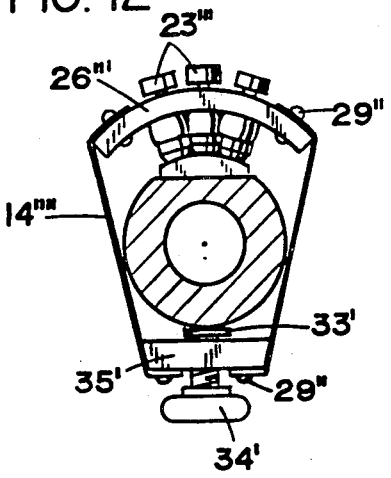
FIG. 12 is an elevation of yet another embodiment of a ligature of this invention.

In FIG. 12, a slightly modified embodiment of the device of FIG. 11 is shown comprising a substantially planar rigid portion 35' to which end extremities of ligature portions 14'''' are fastened by fastening means 29'' without the ligature band extending continuously across the surface of portions 26'''. The embodiment of FIG. 12 is spacially more compact than that of FIG. 11 while providing a similar degree of freedom for vibration of the reed and instrument mouthpiece.

Figure 13:
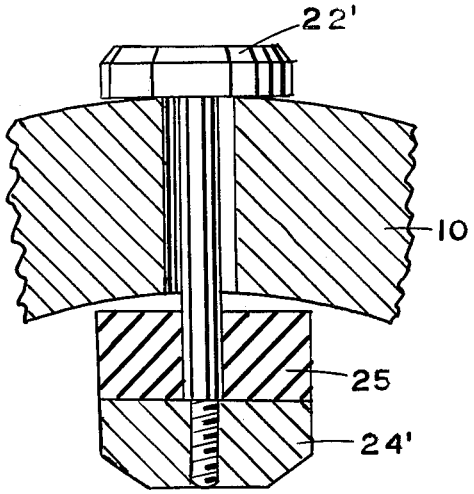
FIG. 13 is a cross sectional elevation similar to FIG. 4, but showing a shoulder bolt rather than a head nut.
Figure 14:
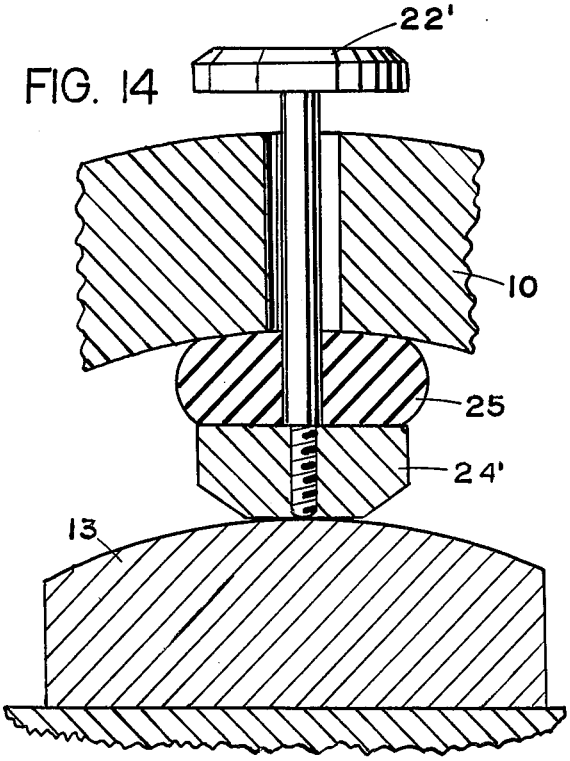
FIG. 14 is a cross sectional elevation similar to FIG. 5, but showing a shoulder bolt rather than a head nut.

In FIGS. 13 and 14 is shown a modification of the embodiment shown in FIGS. 4 and 5 with fixed unitary head 22' shown on the stem assembly in place of retaining nut 23. Such construction may be preferred in some instances to that shown in FIGS. 4 and 5 to avoid loss of the retaining nuts from the assembly from vibration or other inadvertent cause.

Figure 15:
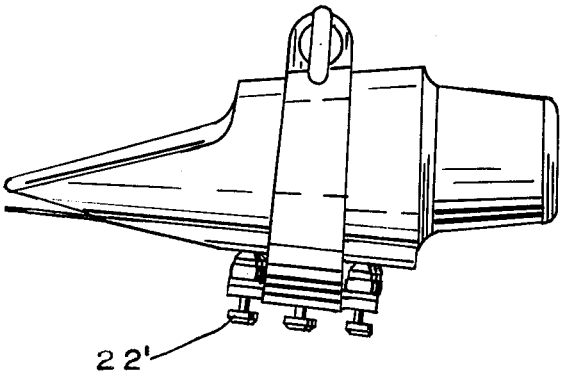
FIG. 15 is a side elevation of a preferred embodiment of a ligature of this invention for use with a saxophone, shown in position ready for use.
Figure 16:
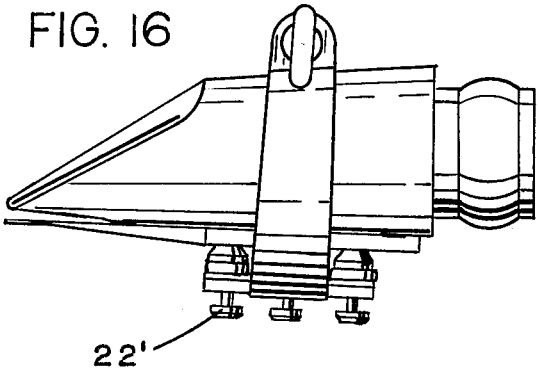
FIG. 16 is a side elevation of a preferred embodiment of a ligature of this invention for use with a clarinet, shown in position ready for use.

FIGS. 15 and 16 show, respectively, clarinet and saxophone mouthpieces constructed with the headed stem assemblies shown in FIGS. 13 and 14.

Figure 17:
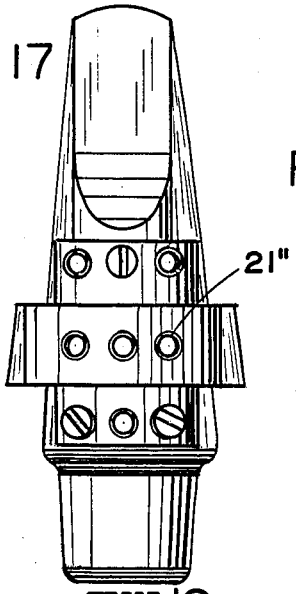
FIG. 17 is a plan view of an embodiment of a ligature of this invention in which the stem assemblies are screw threaded into tapped openings in an arcuate plate portion.
Figure 18:
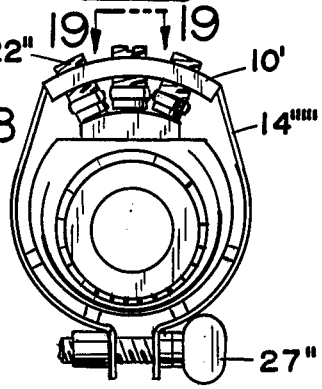
FIG. 18 is an end elevation of the embodiment of FIG. 17.
Figure 19:
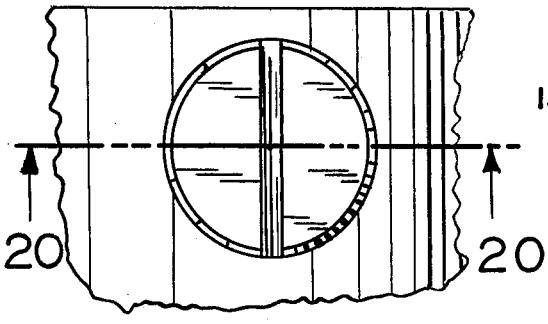
FIG. 19 is a plan view showing in enlarged detail the top of a stem assembly of FIG. 17.
Figure 20:
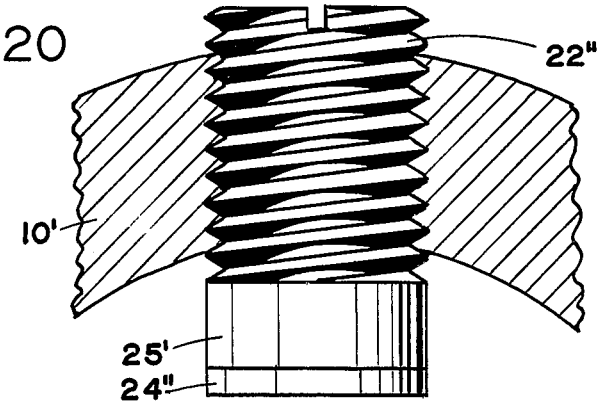
FIG. 20 is a cross-sectional elevation taken on cutting plane 20—20 of FIG. 19 showing a stem assembly mounted in a ligature which is not fitted on a reed.
Figure 21:
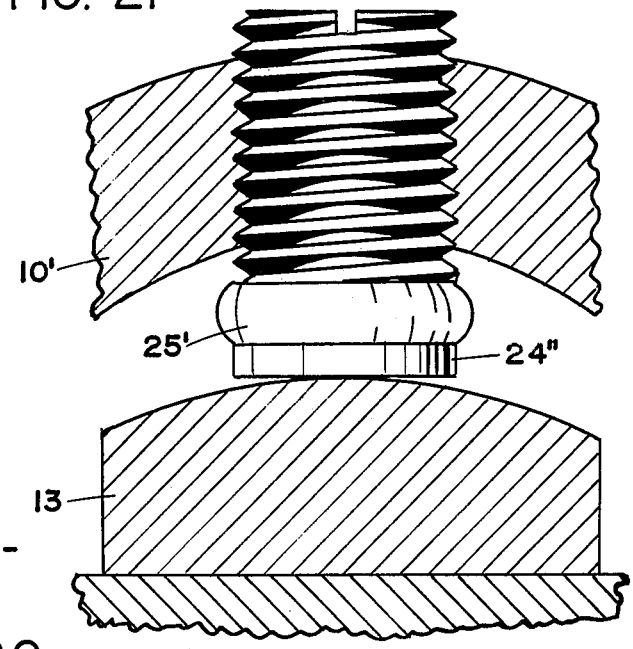
FIG. 21 is a partial cross sectional elevation showing the stem assembly of FIG. 20 operably disposed compressively in contact with a reed.

In the embodiment of invention shown in FIGS. 17 and 18 stem 22'' is completely threaded and is received in tapped arcuate plate 10'. The top of stem 22'' is slotted to receive a screw driver for adjustably positioning the stem in the plate. The bottom surface of stem 22'' is provided with adhesively secured resilient member 25' and unitary metal contact foot 24'', the resilient member being operably compressed by tightening of the ligature band to position foot 24'' against reed 13 as shown in FIG. 21.

A further modified embodiment of the invention is shown in FIGS. 22, 23, and 24 wherein a regular arrangement of six stems 22''' is shown as comprising two parallel lines with the stems grooved and fitted with snap retainer rings 36 thereby providing a low profile for the portions of stems 22''' projecting beyond the face of ligature band 14''''''. Particularly for use on a clarinet, the embodiment of FIGS. 22, 23, and 24 offers the least probability of contact occurring between the ligature and the player's chin.

The particular arrangement of stem assemblies in the embodiments of this invention will be selected to satisfy a player's tonal requirements, but it is usually desirable to provide three contact points in triangular array, such an arrangement providing for firm stable seating of a reed. For instances where the stock surface of the reed requires it, individual stem assemblies may be adjusted to compress resilient member 25 or 25' in greater or lesser degree for each stem in addition to tightening the ligature band to draw all stems into contact with a reed.

Certain embodiments of the invention do not allow for individual ajustment, such as for example those embodiments shown in FIGS. 6, 7, 8, 15, 16, 22, 23, 24, 25, 26, 27, 28, and 29 while other embodiments such as those shown in FIGS. 1, 2, 3, 4, 5, 9, 10, 11, 12, 17, 18, 19, 20, and 21 present a higher profile from the face of the reed as necessary to provide for individual adjustability of the stems. As illustrated in FIG. 25, the axes of stems 22''' disposed in transverse adjacency in ligature 14''''' are separated by the radial angle theta, the radius of curvature being approximately that of the stock face of a reed and also of the ligature band. Note, however, that all embodiments are individually adjustable by selecting from a variety of durometer quantities or spring constants for the resilient member, and a player may choose to provide all embodiments of a single type or may mix the embodiments in a single ligature.

In FIGS. 26 through 29 a preferred enbodiment of the invention is shown utilizing snap retainer rings 36'' for providing a low profile silhouette to a ligature comprising narrow ligature band 14''''''' and single tightening screw 27''' with the band recessed into arcuate plate 10'' to provide a compact assembly. For purposes of enabling a player to easily determine the number and arrangement of stems 22'''' which best meets his tonal requirements, a full complement of nine stems is shown, however, some of the stems may be removed by the player selectively until an optimum tone is achieved. Similarly, various arrangements and selections of stems may be made using any of the various ligatures illustrated, and various positionings and selections of resilient means, spring or cushion, and of differing spring constants or durometer readings may be employed to suit an individual's choice for achieving a desired tonal quality. A mix of resilient means may be used, and a ligature may be installed on an instrument body either in direct contact or separated by the use of spacers as may be desired. In all embodiments, a player has the choice of single to multiple stem assemblies for contacting a reed. Spacers 30 as shown in FIG. 10 may be used in all the embodiments of this invention. If they are used, they may be made of metal or plastic or cushion material and the configuration of the spacers may vary.

In all of the embodiments of this invention, the radial separation of the stem assemblies as shown by the angle theta in FIG. 25 may be greater or smaller rather than being precisely that of the angle shown.

Figure 9:
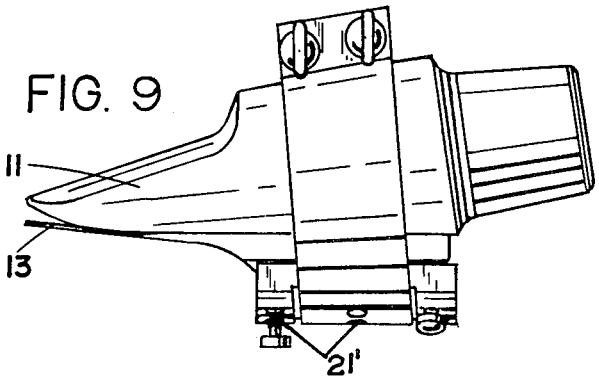
FIG. 9 is a side elevation of the embodiment of a ligature of this invention as shown in FIG. 1, but inverted into position ready for use.

In each of the FIGS. 1 and 9 where no stem assemblies are used in ligature band 14, the band may be fastened to the arcuate plate by bolts or rivets if desired. In any embodiment a cushion spring system may be positioned for operable functioning either on the mouthpiece reed or ligature or spaced at intervals in surrounding disposition and may include either mechanical spring means or cushion material or both.

I claim:

1. A ligature for a single reed musical wind instrument comprising in combination a band for encircling the mouthpiece body of a wind instrument wherein said band is provided with means for tightening and loosening clamping pressure exerted thereby, a plurality of orifices oriented substantially perpendicular axially to surface tangency with said band, at least one post detachably interchangable and selectively disposed among said orifices extending through one said orifice for contacting and securing a reed on a wind instrument mouthpiece body wherein said post embodies an extremity configured as a contact point and comprises a material of selectively chosen resiliently yieldable properties configured and disposed for resiliently transmitting clamping force exerted by said band solely to said contact point independent of any other post, thereby to resiliently secure a reed on a mouthpiece body.

2. The apparatus of claim 1 wherein a relatively rigid arcuate plate portion is provided for transmitting force from said band to said post and wherein said orifices extend through said plate portion and through which said post extends.

3. The apparatus of claim 1 wherein said material of chosen resiliently yieldable properties comprises mechanical spring means.

4. The apparatus of claim 1 wherein said material of chosen resilient yieldable properties comprises elastomer.

5. The apparatus of claim 1 wherein said post is configured with a stem portion disposed extending through one said orifice and an enlarged diameter portion disposed subjacent said encircling band wherein said enlarged portion comprises said material of chosen resilient yieldable properties.

6. The apparatus of claim 5 wherein said enlarged portion comprises in addition a stepped diameter formed shoulder of said stem.

7. The apparatus of claim 5 wherein said stem portion is screw threaded and engaged with threaded means to be axially biased by rotational motion.

8. Apparatus of claim 1 wherein said orifices are disposed to enable said posts to be arranged in triangular array.

9. The apparatus of claim 1 wherein said material of chosen resilient yieldable properties comprises plastomer.

10. The method of securing a reed to the mouthpiece body of a musical wind instrument comprising the steps of positioning a flatted surface of said reed against a flat configured on a mouthpiece body, securing said reed in said position on said mouthpiece body by tightening a ligature to compress resilient yieldable means selectively disposed in at least one of several orifices in said ligature to exert force through at least one contact point against said reed, said yieldable means being discrete for each said contact point, thereby providing vibrational freedom for said reed and mouthpiece body greater than that provided by mounting means having single yieldable means which exert force on multiple contact areas.

11. The method of claim 10 wherein force is exerted at three contact points.

* * * * *